US005154140A

United States Patent [19]

Windon

[11] Patent Number: 5,154,140

[45] Date of Patent: Oct. 13, 1992

[54] CENTERING BASE PAD AND DAM

[75] Inventor: Bradley N. Windon, Hartsville, S.C.

[73] Assignee: AOS Holding Company, Wilmington, Del.

[21] Appl. No.: 647,394

[22] Filed: Jan. 28, 1991

[51] Int. Cl.[5] ..... F22B 37/36

[52] U.S. Cl. ..... 122/494; 122/13.1; 122/13.2; 222/444

[58] Field of Search ..... 122/13.1, 13.2, 19, 122/494; 126/361, 373; 220/444, 445; 264/46.5, 46.6, 46.7, 46.9

[56] References Cited

U.S. PATENT DOCUMENTS 2,303,126 11/1942 Koppel .
3,521,604 7/1970 Nickel .
4,380,215 4/1983 Mendelson .
4,436,058 3/1984 McAlister .
4,527,543 7/1985 Denton .
4,749,532 6/1988 Pfeffer .
4,842,737 6/1989 Reed .
4,844,049 7/1989 Nelson .
4,860,728 9/1989 Nelson .
4,878,459 11/1989 Nelson .
4,972,759 12/1990 Nelson ..... 122/494
4,972,967 12/1990 Nelson ..... 126/361 X
5,005,531 4/1991 Nelson ..... 122/494

*Primary Examiner*—Edward G. Favors
*Attorney, Agent, or Firm*—James Earl Lowe, Jr.; Michael E. Taken

[57] ABSTRACT

In a hot water heater (10), a bottom base pad (34) of relatively rigid insulating material has an outer tapered side (38) allowing clearance of the bottom edge (30) of the outer jacket (14) past the top (40) of the peripheral annular portion (36) of the base pad (34) without snagging, to facilitate assembly, and providing decreasing clearance between the tapered side (38) and the jacket (14) as the jacket is slid downwardly.

7 Claims, 2 Drawing Sheets

CENTERING BASE PAD AND DAM

BACKGROUND AND SUMMARY

The invention relates to insulated fluid storage units, including hot water heaters.

Hot water heaters for domestic and other applications include an inner storage tank having an associated heating unit for heating water in the tank. In an electric hot water heater, the heating unit is typically an electric resistance heating coil within the tank. The tank is surrounded by suitable insulation to retain the heat and minimize the necessity for frequent reheating. An outer aesthetically pleasing jacket or shell is provided around the insulation.

The bottom of the tank and the bottom of the jacket are supported by a lower pan which typically includes thermally insulating base pad material to thermally insulate the tank from the pan and the support surface upon which the pan rests, such as a basement floor. In applications using expanded foam as the insulation between the tank and the outer jacket, the base pad also serves as a dam preventing leakage therepast of the resinous liquid applied to the annular space between the tank and the outer jacket, which resinous liquid foams and expands to produce a rigid and closely adhering insulating enclosure around the inner tank, and for which further reference may be had to U.S. Pat. Nos. 3,521,604 and 4,749,532.

Various types of base pads are known in the prior art. In one form, the base pad is a circular layer of fiberglass upon which the inner tank rests. The outer periphery of the fiberglass is in the annular space between the inner storage tank and the outer jacket, and provides the above noted dam in expanding foam applications.

It is also known in the prior art to provide a base pad precast to a specific size and shape and resting in a bottom pan and receiving the inner storage tank, for example as shown in U.S. Pat. No. 4,878,459, FIGS. 12 and 12*a*.

It is also known in the prior art, as shown in FIGS. 1 and 2 herein, to provide a base pad of expanded polystyrene material in the bottom pan and receiving the inner storage tank and the outer jacket.

BRIEF DESCRIPTION OF THE DRAWINGS

Prior Art

FIG. I shows a water heater construction known in the prior art.

Present Invention

Figure 3:
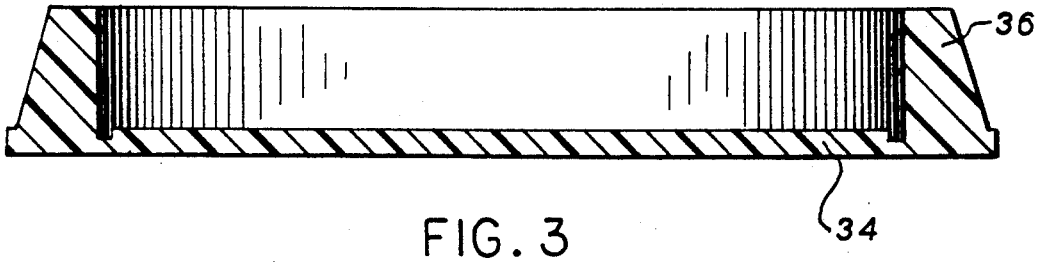

FIG. 3 is a side view of a base pad for a water heater constructed in accordance with the invention.

Figure 4:
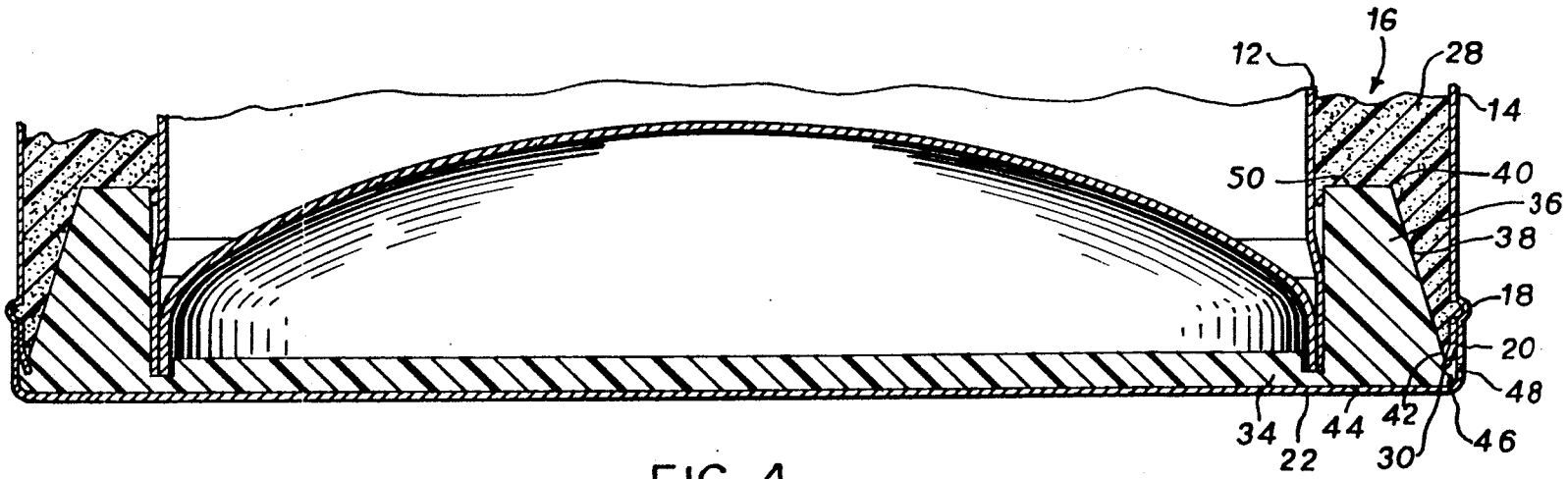

FIG. 4 shows a water heater constructed in accordance with the invention, including the base pad of FIG. 3.

Figure 5:
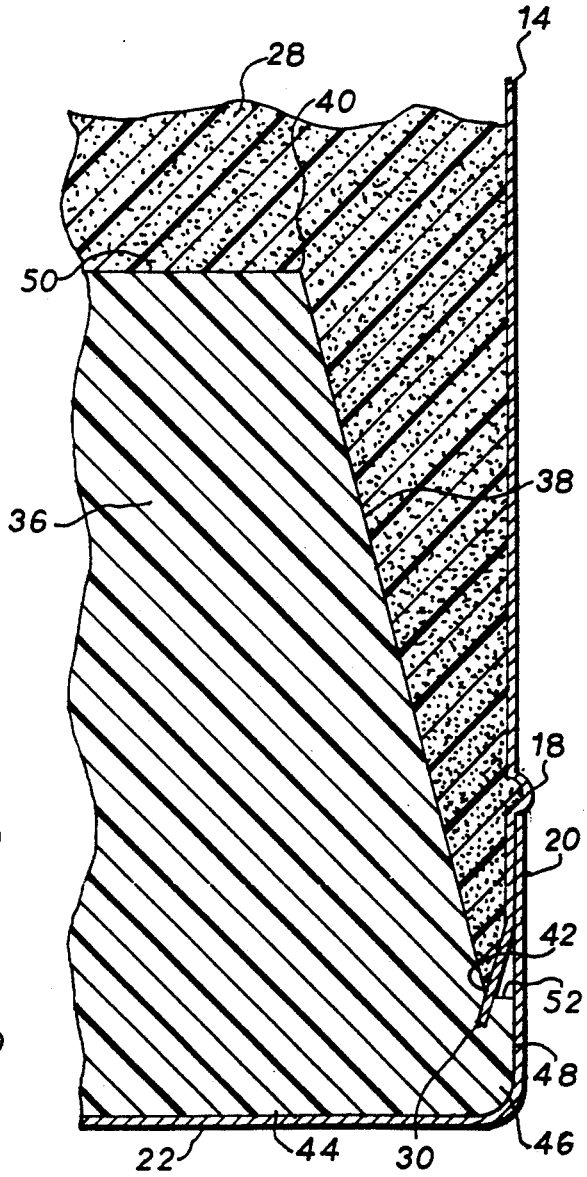

FIG. 5 is an enlarged view of a portion of the structure of FIG. 4.

DETAILED DESCRIPTION

Prior Art

Figure 1:
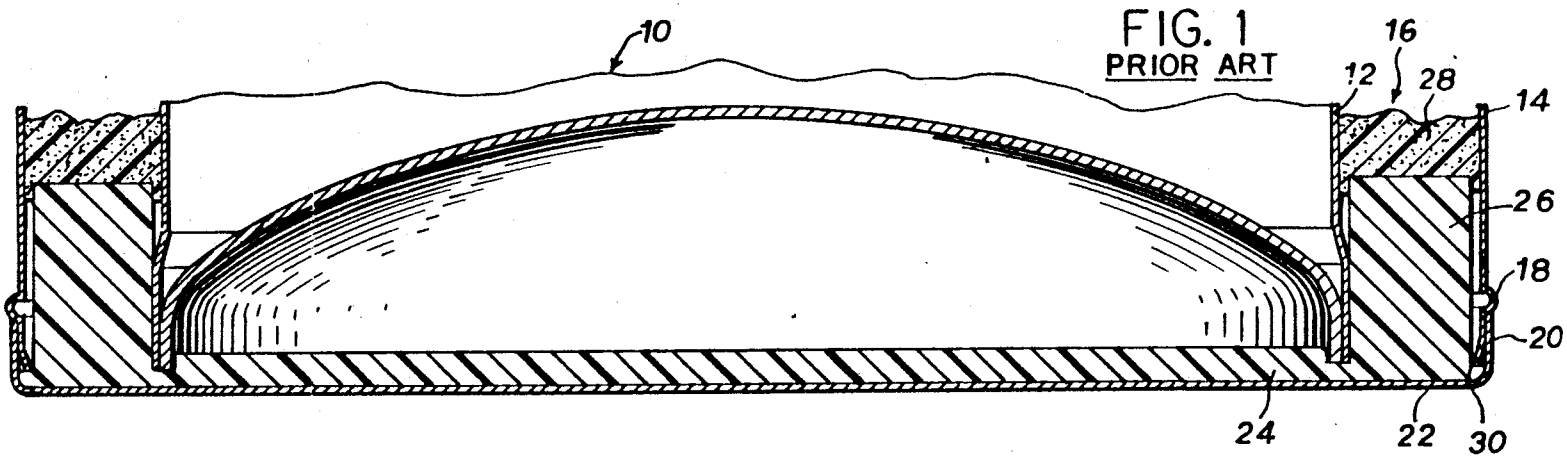
FIG. 1 PRIOR ART

FIG. 1 shows an insulated fluid storage unit such as a hot water heater 10 including an inner storage tank 12 and an outer jacket 14 around the inner storage tank and spaced outwardly therefrom to define an annular space 16 therebetween of given radial thickness. Outer jacket 14 is slid downwardly along inner tank 12 until outwardly rolled dimple 18 of jacket 14 engages upwardly turned sidewall 20 of bottom pan 22. A bottom base pad 24 of relatively rigid insulating material, such as expanded polystyrene, rests on pan 22 and supports inner storage tank 12. Pad 24 has a peripheral annular portion 26 in annular space 16 and forminq a dam in applications wherein foamed insulation is introduced as a liquid into annular space 16 and hardens to form an annular insulation layer 28 around inner storage tank 12. The dam provided by annular portion 26 prevents leakage of the resinous liquid therepast.

Figure 2:
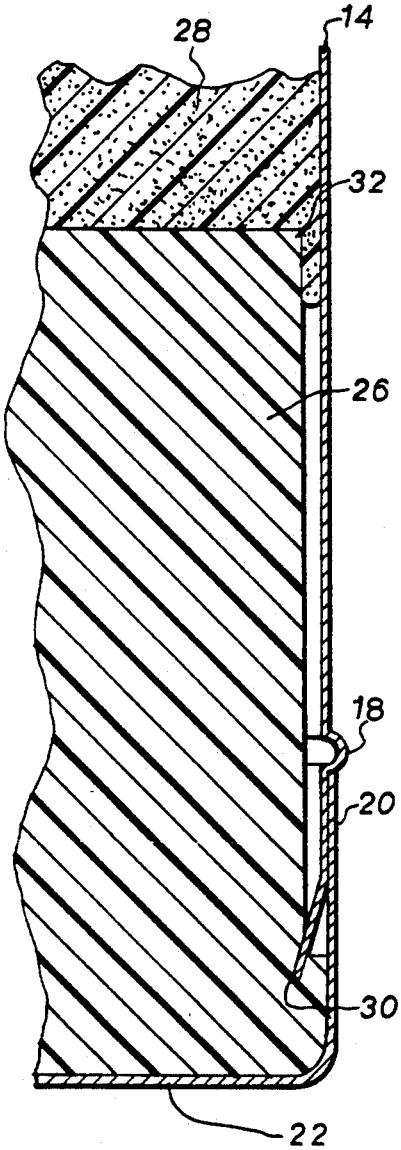
FIG. 2 PRIOR ART
FIG. 2 is an enlarged view of a portion of the structure of FIG. 1.

A problem encountered in the above described structure occurs during assembly. Outer jacket 14 is typically thin sheet steel and has a lower slightly inwardly turned or crimped bottom edge 30, FIG. 2. During assembly, bottom edge 30 of the jacket may snag and rip the top 32 of annular portion 26 of base pad 24, which snagging and ripping impedes the downward movement of outer jacket 14 during assembly.

Present Invention

The present invention provides a simple and effective solution to the above noted snagging problem, and facilitates assembly. FIGS. 3–5 illustrate the present invention and use like reference numerals from FIGS. 1 and 2 where appropriate to facilitate understanding. Bottom base pad 34, FIG. 3, is a relatively rigid insulating material, such as expanded polystyrene, and supports tank 12, and has a peripheral annular portion 36 in annular space 16.

In the present invention, annular portion 36 of the base pad has an outer tapered side 38 allowing clearance of the bottom edge 30 of jacket 14 past the top 40 of annular portion 36 without snagging, to facilitate assembly, and providing decreasing clearance between tapered side 38 and bottom edge 30 of jacket 14 as the jacket is slid downwardly. This solution has been found to be desirably simple and effective, and to provide material cost savings.

Tapered side 38 extends downwardly and outwardly from the top 40 of annular portion 36 such that the radial thickness of annular portion 36 is smallest at the top and increases as tapered side 38 extends downwardly and outwardly. The radial clearance gap between tapered side 38 and outer jacket 14 is greatest at the top of annular portion 36 and decreases as tapered side 38 extends downwardly and outwardly toward outer jacket 14. Outer jacket 14 and tapered side 38 define a generally V-shaped annular space therebetween. Bottom edge 30 of jacket 14 engages tapered side 38 at a point 42 spaced above the bottom 44 of annular portion 36. Tapered side 38 has a top edge at 40 and a bottom edge at 42. Annular portion 36 has a lower section 46 extending radially outwardly from lower end 42 of tapered side 38 such that lower section 46 has an outer surface 48 spaced radially outwardly of lower end 42 of tapered side 38.

In the preferred embodiment, bottom base pad 34 has a peripheral frusto-conical annular portion 36 in annular space 16. Frusto-conical annular portion 36 has a top horizontal surface 50, FIG. 5, a middle horizontal surface 52, and a bottom horizontal surface 44. Frusto-conical annular portion 36 has tapered side 38 extending from top edge 40 at top horizontal surface 50 to a bottom edge 42 at middle horizontal surface 52. Bottom edge 30 of outer jacket 14 clears top edge 40 during downward sliding of outer jacket 14 without snagging, to facilitate assembly. Bottom pan 22 receives bottom base pad 34. Bottom horizontal surface 44 of base pad 34 rests on pan 22. Outer upwardly turned sidewall 20 of bottom pan 22 extends upwardly past middle horizontal surface 52 of base pad 34. Bottom edge 30 of outer jacket 14 is received between outer upwardly turned sidewall 20 of pan 22 and tapered side 38 of pad 34. Bottom edge 30 of jacket 14 digs into pad 34 at the junction 42 of tapered side 38 and middle horizontal surface 52.

It is recognized that various equivalents, alternatives and modifications are possible within the scope of the appended claims.

I claim:

1. An insulated fluid storage unit comprising an inner storage tank, an outer jacket around said inner storage tank and spaced outwardly therefrom to define an annular space therebetween of given radial thickness, said outer jacket being slid downwardly along said inner storage tank, a bottom base pad of relatively rigid insulating material supporting said tank and having a peripheral annular portion in said annular space, said annular portion having an outer tapered side allowing clearance of the bottom of said jacket past the top of said annular portion without snagging, to facilitate assembly, and providing decreasing clearance between said tapered side and the bottom of said jacket as said jacket is slid downwardly, and foamed insulation introduced as a liquid into said annular space and hardened to form an annular insulation layer around said inner storage tank and around said annular portion of said pad, said annular portion of said pad forming a dam preventing leakage of said liquid therepast.

2. The invention according to claim 1 wherein said tapered side extends downwardly and outwardly from the top of said annular portion along a taper angle such that the radial thickness of said annular portion is smallest at the top and increases as said tapered side extends downwardly and outwardly, and such that the radial clearance gap between said tapered side and said outer jacket is greatest at the top of said annular portion and decreases as said tapered side extends downwardly and outwardly toward said outer jacket.

3. The invention according to claim 2 wherein said outer jacket and said tapered side define a generally V-shaped annular space therebetween.

4. The invention according to claim 3 wherein said outer jacket engages said tapered side at a point spaced above the bottom of said annular portion.

5. The invention according to claim 4 wherein said tapered side has an upper edge at the top of said annular portion, and a lower edge spaced above the bottom of said annular portion.

6. The invention according to claim 5 wherein said annular portion has a lower section extending radially outwardly from said lower end of said tapered side such that said lower section has an outer surface spaced radially outward of said lower end of said tapered side.

7. The invention according to claim 1 wherein said pad is formed of expanded polystyrene material.

* * * * *